US006264073B1

(12) United States Patent
Good et al.

(10) Patent No.: US 6,264,073 B1
(45) Date of Patent: Jul. 24, 2001

(54) FLEXIBLE DIP TUBE FOR LIQUID DISPENSER

(75) Inventors: Robert J. Good, Raytown; Jacques J. Barriac, Lee's Summit, both of MO (US)

(73) Assignee: Saint-Gobain Calmar Inc., City of Industry, CA (US)

( * ) Notice: Subject to any disclaimer, the term of this patent is extended or adjusted under 35 U.S.C. 154(b) by 0 days.

(21) Appl. No.: 09/563,238

(22) Filed: May 2, 2000

(51) Int. Cl.[7] ..... B67D 5/60
(52) U.S. Cl. ..... 222/464.4; 222/211; 222/382
(58) Field of Search ..... 222/464.3, 464.4, 222/464.6, 527, 211, 382

(56) References Cited

U.S. PATENT DOCUMENTS

| | | | | |
|---|---|---|---|---|
| 3,547,296 | * | 12/1970 | Greenberg | 215/11 |
| 4,069,950 | * | 1/1978 | Archer | 222/210 |
| 4,830,235 | * | 5/1989 | Miller | 222/464.3 |
| 5,381,961 | | 1/1995 | Evans et al. . | |

FOREIGN PATENT DOCUMENTS

| | | | | |
|---|---|---|---|---|
| 2 136 057-A | * | 3/1983 | (GB) | B65D/83/14 |
| 58-20664 | | 4/1983 | (JP) . | |
| 63-317484 | | 12/1988 | (JP) . | |
| 7-4561 | | 1/1995 | (JP) . | |
| 9-75800 | | 3/1997 | (JP) . | |
| 9-103717 | | 4/1997 | (JP) . | |
| 9-122546 | | 5/1997 | (JP) . | |
| 9-276757 | | 10/1997 | (JP) . | |
| 10-165853 | | 6/1998 | (JP) . | |
| 11-180481 | | 7/1999 | (JP) . | |
| 2000-85817 | | 3/2000 | (JP) . | |

* cited by examiner

*Primary Examiner*—Kevin Shaver
*Assistant Examiner*—Melvin A. Cartagena
(74) *Attorney, Agent, or Firm*—Dykema Gossett PLLC

(57) ABSTRACT

A flexible dip tube for a liquid dispenser, the tube comprising an elongated integrally formed element having elongated end sections and an elongated intermediate section with a pair of spaced bellows defining flexible/weight portions respectively between one end section and the intermediate section and between the other end section and the intermediate section, one of the bellows functioning as a weight filled with liquid causing the tube to flex at the other end of the bellows.

3 Claims, 1 Drawing Sheet

FLEXIBLE DIP TUBE FOR LIQUID DISPENSER

BACKGROUND OF THE INVENTION

This invention relates generally to a flexible dip tube which depends from a manual dispenser and which extends into the liquid of a container to which the dispenser is mounted. The distal end of the tube tracks the bottom wall of the container and remains immersed in the liquid at low liquid levels even when spraying in upward and downward positions.

There are a wide variety of flexible dip tubes provided for liquid dispensers which are flexible for tracking the bottom wall of the container under the aforestated conditions. One such known dip tube is corrugated throughout its length or has the main portion of its length corrugated to provide flexibility, and which provides a weight in the form of a ball or the like at the distal end of the tube for maintaining that end immersed in the liquid when spraying from a nearly empty container in downward and upward attitudes of the sprayer. Such a dip tube is disadvantaged in several respects in that the increased diameter of the tube due to the large number of corrugations requires an unduly high number of pumping strokes to prime the pump given that air in the tube and in the pump chamber must be displaced with the liquid to achieve a full prime. Moreover, such a prior art tube requires an additional part in the form of a ball weight which adds to the cost of the overall dispenser package. Beside such a weight is difficult and time consuming to sub-assemble and yields mixed results.

Other prior art flexible dip tubes are known as having a limited corrugated section forming a bellows which thereby reduces the strokes-to-prime ratio to manageable levels but likewise requires some type of weight at its distal end in the form of a ball or other dense object for maintaining that end immersed in the liquid when dispensing from a nearly empty container in downward and upward attitudes of the sprayer. Again the cost and inconvenience of providing the weight is generally unacceptable in the industry of manual dispensers.

Still other known dip tubes have an integrally formed enlarged section which functions as a weight when the dip tube and the enlarged section accumulate liquid during priming. However, no integral flexible section is provided for such a known dip tube which is a drawback.

Also it is known that during the high speed assembly process practiced with modern day machinery, the standard dip tube of constant diameter between its ends is inserted into the tube retainer of the dispenser at either end of the tube. During the assembly process, a gripper grips an end section of the tube adjacent that end being inserted into the tube retainer. The length of the tube so gripped covers a tube length of about 1 inch or more for a 10 inch tube, for example.

This tube assembly process, while operating efficiently for dip tubes with constant diameter between their opposite ends, will not suffice for flexible dip tubes of the type known in the art. For example, since the flexible, and some end-weighted, dip tubes according to the prior art are not symmetrical about a central transverse axis, there is but one end, i.e., the proximate end, at which the dip tube can be coupled to the dip tube retainer of the dispenser or sprayer. The dip tubes must be first oriented with their proximate ends facing in a common direction, which requires an additional step in the assembly process and considerably slows the assembly process.

SUMMARY OF THE INVENTION

It is therefore an object of the present invention to provide a dip tube for a handheld dispenser which avoids the aforedescribed drawbacks and which requires no specific orientation prior to its assembly to the dispenser. The dip tube according to the invention can be installed using the same high speed assembly machines provided in modern machine assembly operations.

The flexible dip tube according to the invention has opposing end sections of a given length and an intermediate section of some predetermined length. Each of the sections is of substantial rigid material, and the dip tube has a pair of integrally formed bellows sections respectively interposed between one end of the intermediate section and the adjacent end section, and between the other end of the intermediate section and the other adjacent end section. In use the bellows section adjacent the distal end of the tube functions as a weight as the bellows section accumulates liquid during the dispenser priming process. The weighted distal end of the tube flexes about the other bellows section located near the proximate end of the tube for maintaining the distal end submerged in the container liquid when dispensing during a near empty container condition. The distal end thus tracks the bottom wall of the container during dispensing between downward and upward positions.

In accordance with another feature of the invention, the dip tube is symmetrical about a transverse central axis such that the bellows sections are at equidistant locations from their respective ends of the tube, and such that the tube is capable of being coupled to the tube retainer of the dispenser at either of its ends, without orientation, as in any standard dip tube. The tube end sections should be of a sufficient length permitting the automated gripper to engage a standard length of the rigid end section during assembly.

Other objects, advantages and novel features of the invention will become more apparent from the following detailed description of the invention when taken in conjunction with the accompanying drawing.

DETAILED DESCRIPTION OF THE INVENTION

Figure 1:
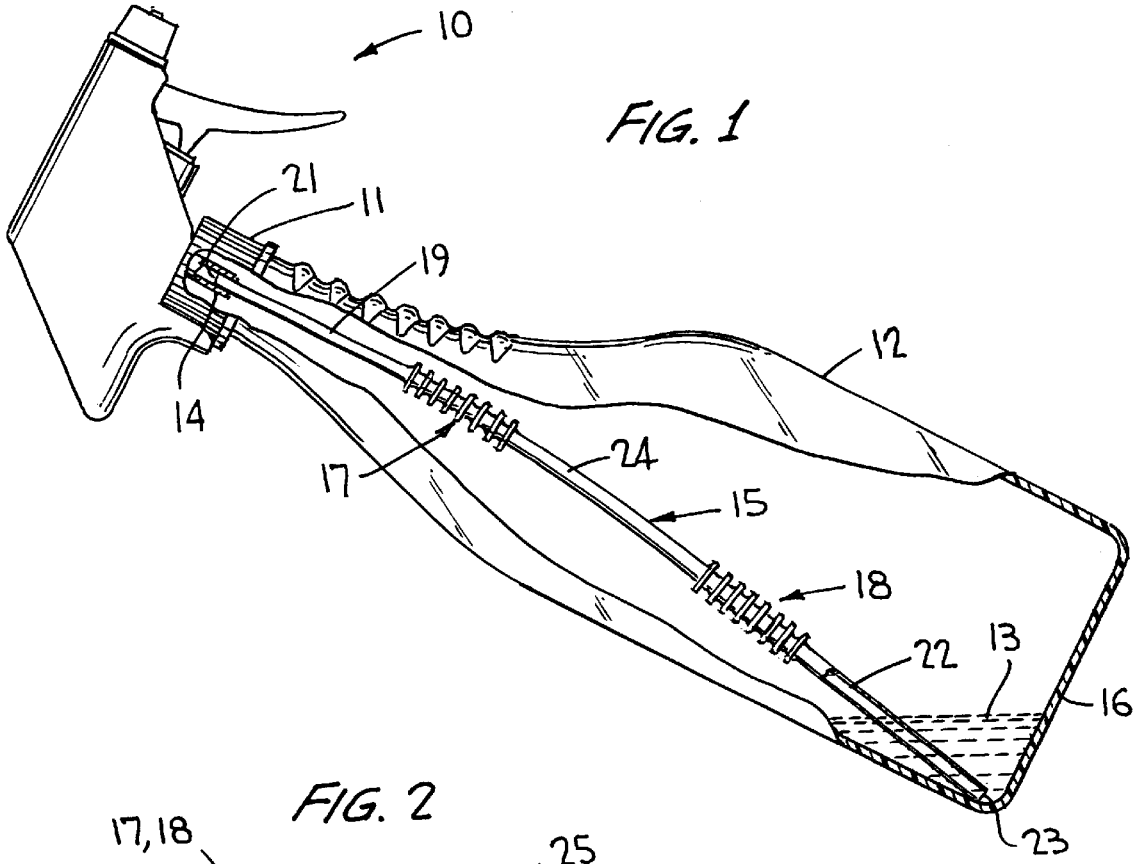
FIG. 1 is a side elevational view of a known dispenser mounted to a container of liquid to be dispensed as shown partly broken away which illustrates the flexible dip tube according to the invention.

Turning now to the drawings wherein like reference characters refer to like and corresponding parts throughout the several views, a trigger actuated pump sprayer generally designated 10, of some known variety, is shown mounted by its threaded closure 11 to the neck of a container 12 of liquid 13 to be dispensed. As it is well known in the art, a dip tube, sometimes referred to as an induction tube or a liquid pickup tube, is coupled to a tube retainer 14 of the dispenser pump body. Dip tube 15 according to the invention is coupled to tube retainer 14 as by a frictional, telescoping fit, and extends into the interior of container 12 toward bottom wall 16 thereof. As is typical for all manually actuated pump sprayers, of the trigger actuated type as shown or of the fingertip actuated type typically used for spraying personal care products, the sprayer is mounted on a full container of liquid product to be dispensed. The consumer must therefore prime the pump by actuating the pump piston several times to replace the air within the inlet passage and the pump chamber with liquid 13. Priming takes place in accordance with any of a number of known priming systems. Thus when the dispenser is primed, its dip tube is filled with liquid such as 13 and is suctioned into the pump chamber during each suction stroke as liquid product is conveyed from the container up through the dip tube and into the pump chamber. A low strokes-to-prime ratio is critical in this manual actuated pump dispenser art, and needs to be maintained as low as possible.

The unitary dip tube 15 according to the invention is formed of a continuous length of tubing of relatively rigid plastic material such as a homopolymer polypropylene. The tubing is corrugated at two spaced apart locations to form a pair of spaced apart bellows sections 17 and 18 according to the invention, and is therefore cut to size, for example, 10 inch lengths. The spaced apart pair of bellows sections are located along the length of the tube so as to define an end section 19 which includes proximate end 21 of the tube, an end section 22 which includes distal end 23 of the tube, and an intermediate section 24. Thus bellows section 17 is interposed between sections 19 and 24, and bellows section 18 is interposed between sections 22 and 24.

To conveniently avoid the need to orient the dip tubes prior to assembly with the dispensers, the flexible dip tube according to the invention is symmetrical about its transverse central axis. Thus bellows sections 17 and 18 are equidistant from their respective ends 21 and 23 leaving end sections 19 and 22 each substantially of the same length.

The specific location of bellows sections 17 and 18 from their respective ends 21 and 23 must be chosen such that a sufficient length at each end section is available for the standard automated gripper to embrace a given length of the tube in the process of coupling the tube to the tube retainer of the dispenser. Also the location of the bellows sections must be sufficiently close to their respective ends 21 and 23 so as to achieve the desired tip displacement at distal end 23 of the dip tube in tracking bottom wall 16 of a near empty container as will be described in more detail hereinafter. Also, the bellows location helps keep the lower bellows 18 from floating on top of the water. Moreover, tip displacement is higher the closer the bellows sections are at their respective ends of the tube. This is due to the center of gravity of the tube mounted at its proximate end being located further from the point of flexibility.

For a 10 inch tube, for example, it has been determined that the optimum bellows location is 2½ inches from the respective ends 22, 23 which is the farthest outboard locations of the bellows section without interfering with existing assembly tools.

Figure 2:
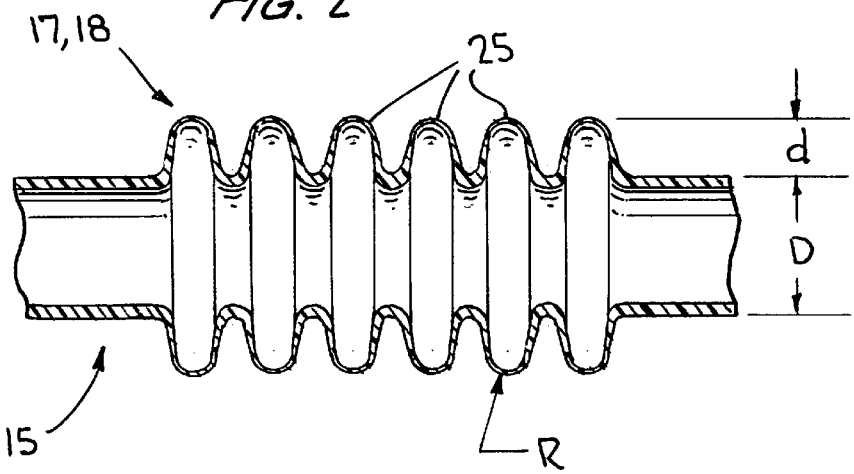
FIG. 2 is a sectional view, at an enlarged scale, of a bellows section of the tube according to the invention.

The tip displacement at the distal end of the tube is a function of the depth of the corrugation, it being shown that a greater corrugation depth yields greater flexibility at the bellows section compared to a lesser corrugation depth. The corrugation depth d shown in FIG. 2 is in the arrange of 20 to 25 percent of diameter D of the tube.

The next determinative factor is the outer radius R of each of the corrugations of the bellows. Basically the smaller the radius, the greater number of bellows producing a higher stress and a higher tip displacement but a lower fluid volume of liquid accumulated within the bellows. Because of fluid volume, i.e., the amount of liquid accumulated within bellows section 17 and within bellows section 18, influences the number of strokes-to-prime when priming the dispenser, a reduced number of corrugations of the bellows section radius R was varied to achieve the lowest fluid volume with the greatest tip displacement, which stresses were noted as sufficiently higher compared to other designs having a greater radius R. Since plasticity and creep resulting from shipping can adversely affect the functionality of the dip tube, a radius R of 0.030 inches was selected for tube diameter d of 0.189 inches. Compared to a higher radius R, for example, 0.045 inches, the 0.030 radius produces a significantly lower fluid volume at the expense of only a slightly higher stress. And the number of corrugations selected was six as the optimum in fluid volume, tip displacement and tube stress.

In operation, the dispenser will have been primed at the outset of its use and after repeated dispensing operations the container will be in a near empty condition as shown in FIG. 1. Since the dispenser is primed, dip tube 15 is essentially filled with liquid 13 including amounts of liquid additionally accumulated in the corrugations of bellows sections 17 and 18. The corrugations of bellows 17 function at all times effectively as a flexible hinge permitting distal end 23 of the dip tube to track bottom wall 16 of the container when spraying between an upward position (the inclination of the sprayer package of FIG. 1 rotated counterclockwise slightly to horizontal) and a downward position (the sprayer package of FIG. 1 rotated clockwise to a horizontal position). Thus when the liquid in a container decreases to a level below that of bellows section 18, as typically shown in FIG. 1, bellows section 18 functions as a weight assuring that the free end of the tube remains submerged in liquid 13 when spraying in attitudes between upward and downward as defined above.

Thus each bellows section defines a flexible/weight portion of the tube. In the tube position of FIG. 1 wherein end 21 is proximate, bellows section 17 functions as a flexible hinge which is a locus of flexion, while bellows section 18 acts as a weight effecting tube displacement and flexing as restricted to the locus of flexion at bellows 17. Conversely, when end 23 is the proximate end as when that end section 22 is grasped by the assembly equipment for inserting end 23 into the tube retainer of the dispenser, bellows section 18 defines a locus of flexion which provides a flexible hinge, while bellows section 17 provides a weight effecting tube displacement causing it to flex solely at the locus of flexion 18.

It should be noted that flexible tube 15 is assembled to the dispenser from either end as aforedescribed and is shown with end sections 19 and 22 being of equal length. This assumes that a section of the tube end is not cut off to accommodate the height of container 12. Typically, however, after tube 15 is assembled to the dispenser with its end sections 19 and 22 having equal length, a short end section may be removed from the free end of the dip tube before being delivered to the customer to accommodate the height of a specific container.

Figure 3:
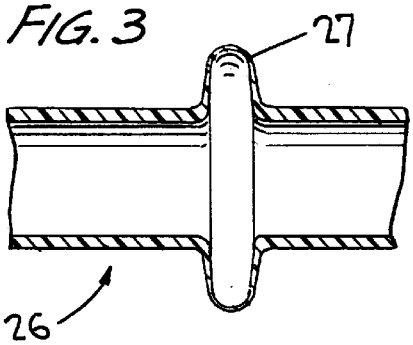
FIG. 3 is a view similar to FIG. 2 of a variant of the bellows section according to the invention.

Although the optimum number of corrugations 25 arrived at is six for the reasons developed hereinabove, it should be pointed out that dip tube 26 of FIG. 3 could have but a single corrugation 27 without departing from the invention. The D and the d dimensions described with reference to FIG. 2 would likewise apply to dip tube 26.

Also the invention has been described in relation to a manually actuated (trigger or fingertip) pump sprayer, although the flexible dip tube according to the invention is not so limited in its use. For example, the dip tube of the invention could be utilized equally well with a squeeze dispenser or with an aerosol, without departing from the invention.

From the foregoing it can be seen that a flexible dip tube has been devised which is of unitary construction, is capable of being assembled from either end as in any standard dip tube, yet is highly effective and economical to produce and assemble. The pair of spaced bellows sections each define a flexible/weight portion for the dip tube, with that bellows section located adjacent the proximate end functioning as a flexible hinge, and that bellows section adjacent the distal end functioning as a weight for tracking the bottom wall of the container during different inclinations of the package during operation to thereby maintain the distal end immersed in the liquid of the near empty container for discharging more product from the container while permitting dispensing in both upward and downward extreme positions of the sprayer.

Obviously many modifications and variations of the present invention are made possible in the light of the above teachings. For example, the bellows 25 or 27 may have a shape other than a radius R, such as a V-shape in cross-section or the like, without departing from the invention. It is therefore to be understood within the scope of the appended claims the invention may be practiced otherwise than as specifically described.

What is claimed is:

1. A liquid dispenser, comprising, a dispenser body supporting a closure cap for mounting the body to a container of liquid to be dispensed, an elongated unitary dip tube coupled at a proximate end thereof to said body and extending at a distal end thereof into the liquid in the container for defining a liquid inlet passage to the dispenser, said dip tube having end sections and an intermediate section, said dip tube being of plastic material with each of said sections being rigid, and said dip tube having a pair of integrally formed bellows sections respectively joined to opposite ends of said intermediate section and to the respective end sections, and said bellows sections each solely defining a locus of flexion for the tube and each comprising at least one bellows corrugation having an outer diameter greater than an outer diameter of said intermediate and end sections, and having an inner diameter greater than an inner diameter of said intermediate and end sections, the distal end of the tube being weighted down and immersed in the liquid in the container by the bellows section adjacent the distal end containing accumulated liquid by reason of said greater outer and inner diameters thereof so as to ensure uninterrupted dispensing when dispensing during upward and downward positions of the dispenser.

2. The dispenser according to claim 1, wherein each of said end sections have substantially the same predetermined length for spacing each of the bellows from said ends of the tube an equal predetermined distance permitting either of said ends to define said proximate end.

3. The dispenser according to claim 1, wherein each of said bellows comprises at least six corrugations.

* * * * *